United States Patent [19]

Cooke

[11] Patent Number: 4,686,777

[45] Date of Patent: Aug. 18, 1987

[54] PREVENTING SHEET FLUTTER IN PAPER WEB DRYERS

[75] Inventor: Ronald D. Cooke, Beloit, Wis.

[73] Assignee: Beloit Corporation, Beloit, Wis.

[21] Appl. No.: 878,834

[22] PCT Filed: Feb. 21, 1986

[86] PCT No.: PCT/US86/00374

§ 371 Date: Feb. 21, 1986

§ 102(e) Date: Feb. 21, 1986

[51] Int. Cl.[4] ..... F26B 13/08

[52] U.S. Cl. ..... 34/116; 34/122; 34/123

[58] Field of Search ..... 34/114, 116, 117, 120, 34/122, 123

[56] References Cited

U.S. PATENT DOCUMENTS

| | | | |
|---|---|---|---|
| 4,190,964 | 3/1980 | Schiel | 34/114 |
| 4,202,113 | 5/1980 | Kankaanpaa | 34/114 |
| 4,359,827 | 11/1982 | Thomas | 34/114 |
| 4,359,828 | 11/1982 | Thomas | 34/114 |
| 4,441,263 | 4/1984 | Vedenpaa | 34/116 |
| 4,502,231 | 3/1985 | Fissmann et al. | 34/114 |
| 4,516,330 | 5/1985 | Eskelinen et al. | 34/114 |
| 4,566,946 | 1/1986 | Koponen et al. | 34/114 |
| 4,628,618 | 12/1986 | Virta et al. | 34/116 |

*Primary Examiner*—Albert J. Makay
*Assistant Examiner*—David W. Westphal
*Attorney, Agent, or Firm*—Dirk J. Veneman; Raymond W. Campbell; Gerald A. Mathews

[57] ABSTRACT

A vacuum device (15, 15') and method for avoiding sheet flutter in an on-running tangent pocket (14, 14') defined between the perimeter of a dryer roll (9, 9'), and a free transitional span (13, 13') of a dryer felt (7, 7') travelling toward the dryer roll and carrying a wet paper sheet web (8, 8') on the face of the felt outside of the tangent pocket. The device comprises an elongate hollow manifold (17, 17') arranged to extend longitudinally within the pocket (14, 14') parallel to the felt (7, 7') and web (8, 8'). The air in the pocket (14, 14') is vacuumed into a chamber (16, 16') within the manifold (17, 17') through an arrangement of ports (21, 21', 22, 22') communicating with the vacuum chamber. A suction member (20, 20') draws the air from the vacuum chamber (16, 16') and communicates with a vacuum source (34).

2 Claims, 5 Drawing Figures

PREVENTING SHEET FLUTTER IN PAPER WEB DRYERS

DESCRIPTION

This invention relates to improvements in paper web dryers, and is more particularly concerned with preventing sheet flutter in such dryers.

Paper web dryers receive freshly formed paper sheet web from a paper making machine on a porous belt, commonly referred to as a dryer felt. The dryer felt is trained to travel over a series of heated dryer rolls. These rolls may be arranged in a vertical stack or in an alternately offset horizontal arrangement wherein the web-carrying felt travels in a generally serpentine dryer path. In either arrangement, the paper web carried by the felt runs in contact with the perimeter of alternate rolls while the felt runs in contact with the perimeters of the remaining rolls.

In a free span between dryer rolls where the still wet web has travelled in contact with a dryer roll perimeter and the felt runs tangentially toward the perimeter of the next succeeding dryer roll, the web is susceptible to damage from sheet flutter due to the air frictionally drawn into tangent pocket defined by the next succeeding roll perimeter and the felt. That is, since the felt is porous, the air drawn into and substantially trapped in the on-running tangent pocket tends to push through the felt toward the web carried on the outside of the free span there is a tendency to flutter and dislodge the wet web from the felt with damaging results. This condition is especially aggravated at high processing speeds in the drying of maximum width paper webs. The drawn in air tends to be trapped in the tangent pocket.

It is to the alleviation of this problem that the present invention is directed.

An important object of the present invention is to alleviate the problem of sheet flutter in high speed paper sheet web dryers.

Another object of the invention is to provide a new and improved method of and means for vacuuming frictionally indrawn air from on-running tangent pockets in high speed paper web dryers.

In accordance with the principles of the present invention, there is provided for high speed dryers wherein a felt carries a paper sheet web over dryer rolls and the felt forms an on-running tangent pocket with the perimeter of a dryer roll and into which pocket air is frictionally drawn by the on-running roll perimeter and felt tending to cause sheet flutter, a vacuum device comprising an elongate hollow manifold for extending longitudinally within the pocket parallel to the felt and web; and opening means substantially throughout the length of the manifold for vacuuming the air from the pocket into the manifold, and thereby avoiding the sheet flutter.

The present invention also provides a new and improved method of avoiding sheet flutter in high speed dryers.

Other objects, features and advantages of the present invention will be readily apparent from the following description of a representative embodiment thereof, taken in conjunction with the accompanying drawing, although variations and modifications may be effected without departing from the spirit and scope of the novel concepts embodied in the disclosure, and in which.

Figure 1:
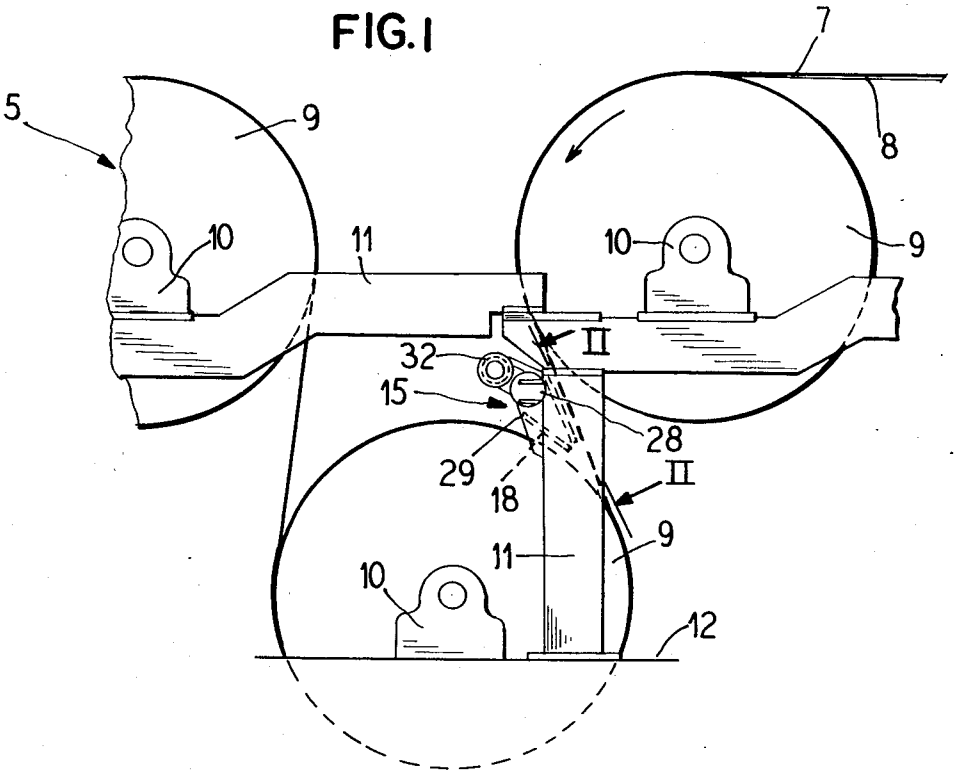
FIG. 1 is a fragmentary side elevational view of a high speed dryer embodying the invention.

By way of illustration, there is shown in FIG. 1 a horizontal high speed paper web dryer 5 wherein a paper making felt 7 carrying a paper sheet web 8 from a paper making machine, and travels in a serpentine drying path over heated dryer rolls 9, the construction and operation of which is well known. These dryer rolls are generally steam heated and as the web carrying felt progresses through the dryer, the moisture is progressively driven from the paper web. Typically, the dryer rolls are supported on bearings 10 and an upper tier of the rolls 9 may be supported by a machine frame 11 while the bearings 10 of a lower tier of the rolls 9 alternating with the upper tier of rolls 9 may be supported at dryer room floor level 12 with the lower perimeter portions of the lower tier of rolls 9 accommodated in the upper portion of a drainage trough or sump.

Especially where the paper web 8 still carries a fairly high proportion of water following the paper making felting process, it is important to maintain uniform adherence of the paper sheet web 8 to the dryer felt 7 in order to maintain smooth integrity of the sheet. Flutter tending to dislodge paper web 8 from the dryer felt 7 is detrimental to attainment of high quality dried paper web.

Liability of sheet flutter is especially encountered where there is a free transitional span 13 from the roll 9 on which the paper web 8 is in peripheral running contact, and the dryer roll 9 toward which the dryer felt 7 is running in peripheral contact. In this free span 13, the paper web 8 is at the outside of the dryer felt 7, and the felt defines an on-running tangent pocket 14 (FIG. 3) with the perimeter of the roll 9 toward which the felt is running, as indicated by directional arrow in FIG. 3. At the usually high speed of operation of the dryer, that is, the high speed at which the felt 7 carrying the web 8 and the dryer rolls 9 are running, air frictionally drawn into the generally wedge shaped tangent pocket 14, has a tendency to accumulate and because of the density of the paper web 8, which blocks escape of the accumulated air through the porous dryer felt 7, tends to cause paper web sheet flutter liable to damage the paper web.

Figure 2:
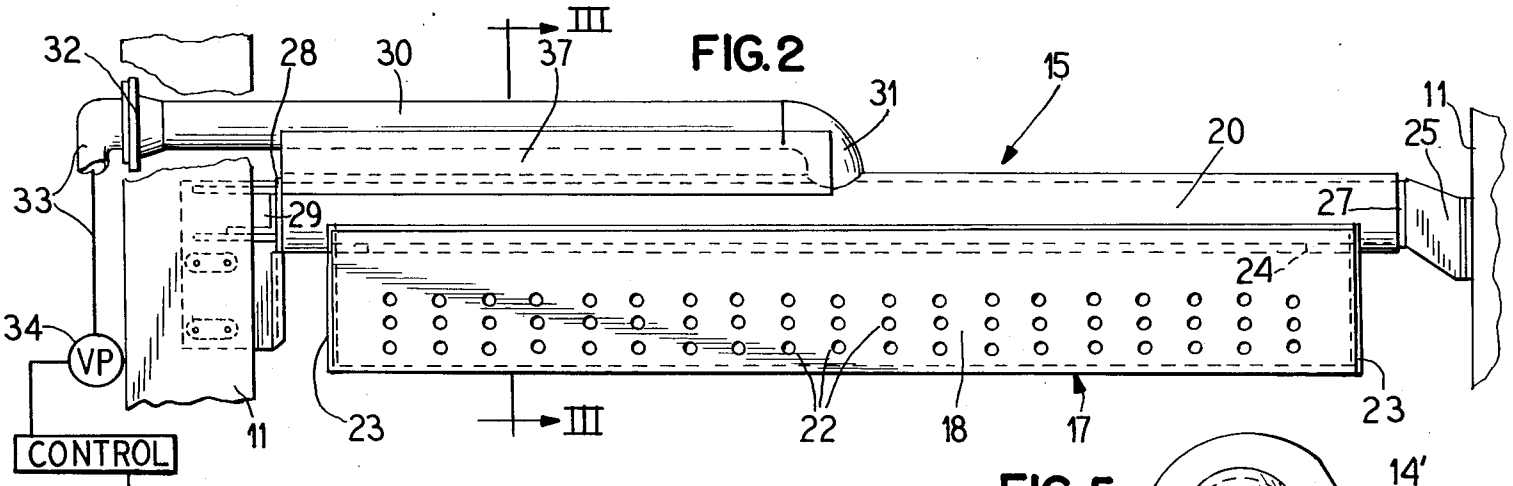
FIG. 2 is an enlarged fragmentary elevational detail view taken substantially along the line II—II in FIG. 1.

According to the present invention, means are provided for avoiding sheet flutter, comprising a vacuum device 15 within the pocket 14. In a preferred construction, the device 15 comprises an elongate hollow shell defining a vacuum chamber 16 within a manifold 17 extending longitudinally parallel to the felt 7 and web 8 and of a length about the same as the width of the felt 7. In a simple, efficient, economical construction of the manifold 17, two substantially coextensive flat wall panels 18 are secured as by means of welding 19 to a header suction pipe 20. From the suction pipe 20, the manifold wall panels 18 converge toward one another substantially complementary to the convergence of the felt 7 and the roll 9 defining the progressively diminishing cross section, generally wedge shaped tangent pocket 14. At their convergent edges, the panels 18 define a slit orifice 21 extending substantially the full width of the felt 7. This provides part of opening means substantially throughout the length of the manifold 17, and including a uniform array of ports 22 through each of the panels, for vacuuming the air from the pocket 14 into the manifold chamber 16. As best seen in FIG. 2, the ports 22 may be by way of example, but not limitation, in three longitudinally extending spaced rows. The ports 22, together with the orifice 21 should be selected for respectively number and size to provide high volume intake into the manifold chamber 16 while maintaining structural strength integrity of the manifold panels 18. At the opposite ends of the panels 18, the manifold 17 has respective end plates 23 so as to concentrate suction into the chamber 16 within the manifold 17 through the slit orifice 21 and the suction ports 22. For efficient evacuation of air from the chamber 16, the suction pipe 20 has an intake or suction port 24 which extends substantially throughout the length of the manifold 17 and is of a width as great as practicable at the maximum width of the manifold chamber 16.

In addition to its evacuation suction function, the pipe 20 serves as means by which the vacuum device 15 is supported by the machine frame 11. To this end, a bracket 25 connects a closure 27 at one end of the pipe 20 to a part of the machine frame 11, and a closure 28 at the opposite end of the pipe 20 is connected by a bracket 29 to another part of the machine frame 11.

For supplying vacuum to the suction pipe 20, a suction exhaust duct 30 is connected by means of a suction elbow 31 to preferably about the longitudinal center of the suction pipe 20 and opposite the suction port 25. At its opposite end, the duct 30 is connected as by means of a coupling 32 to a suction line 33 communicating with a vacuum source such as a vacuum pump 34, or other vacuum source such as a fan. Means such as a suitable control device 35 regulates the vacuum generated by the pump 34 or fan so that vacuuming of the air from the tangent pocket 14 will be effected efficiently and without overdraft which might suck the felt 7 toward the vacuum device 15 and interfere with smooth, unhampered running of the felt. A stabilizing and reinforcing member such as a plate 37 is secured as by welding to and between the pipe 20 and the duct 30.

Figure 5:
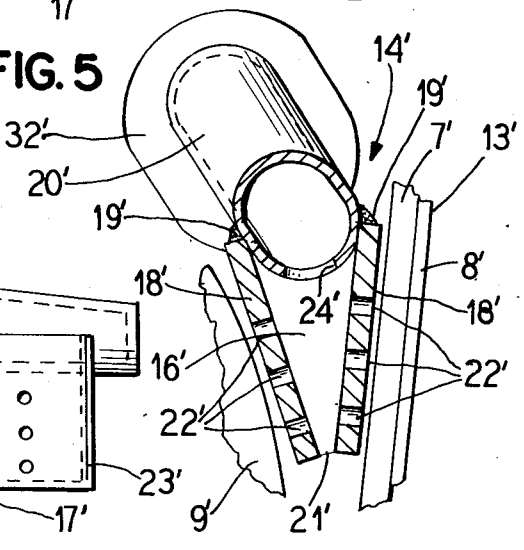
FIG. 5 is a sectional detail view taken substantially along the line V—V in FIG. 4.
Figure 4:
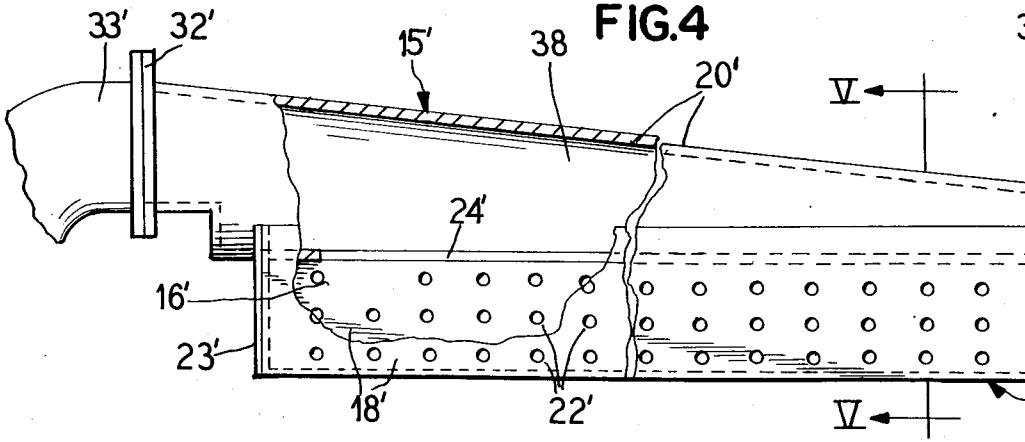
FIG. 4 is a fragmental elevational detailed view, partially broken away and in section of a vacuum device functionally similar to the vacuum device in FIG. 2, but somewhat simplified in structure.

In the modification shown in FIGS. 4 and 5, the vacuum device 15' is functionally substantially the same as the device 15 in FIG. 2 and the device 15' is constructed and arranged to be mounted operationally in the same manner within the generally wedge-shaped tangent pocket 14' defined by the drier roll 9' and the felt 7' and paper web 8' carried thereby in the span 13'. The vacuum chamber 16' within the manifold 17' defined by cooperating wall panels 18' which are secured as by means of the welding 1' to the header pipe 20'. The convergent wall panels 18' provide the slip orifice 21' and suction ports 22'. At the opposite ends of the vacuum chamber 16', the manifold 17' is closed by means of respective end plates 23'.

In this instance, the suction header pipe 20' is of generally tapered form providing a progressively greater cross sectional flow area passage 38 along the slit suction port 24'. At its larger end, the header 20' is attached as by means of coupling 32' to suction line 33'.

Figure 3:
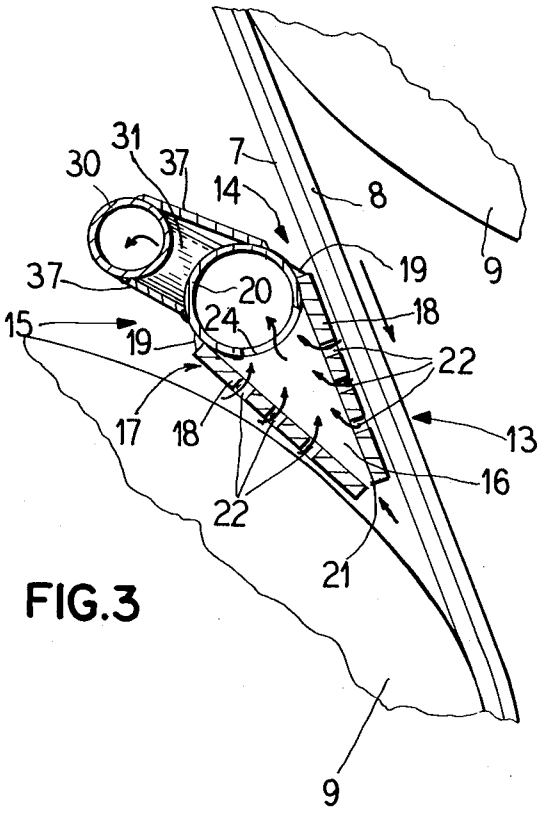
FIG. 3 is a sectional detail view taken substantially along the line III—III in FIG. 2.

It will be appreciated that the elements identified by primed reference characters in FIGS. 4 and 5 function substantially the same as the similar elements in FIGS. 2 and 3, and accordingly a more abbreviated description has been employed. The more detailed description in respect to FIGS. 2 and 3 may be referred to if necessary.

It will be understood that variations and modifications may be effected without departing from the spirit and scope of the novel concepts of the present invention.

I claim:

1. In combination with a high speed dryer wherein a felt carries a paper sheet web over dryer rolls, and the felt forms an on-running tangent pocket with the perimeter of a dryer roll and into which pocket air is frictionally drawn by the on-running roll perimeter and felt tending to cause sheet web flutter:

a vacuum device comprising an elongate hollow manifold extending longitudinally within said pocket parallel to said felt and web, said manifold comprising a vacuum chamber defined between a pair of convergent wall panels, respective ones of said wall panels being in parallel spaced adjacency with the on-running felt, and in tangent spaced adjacency with the dryer roll;

and opening means, including an array of vacuum ports in the wall panels, substantially throughout the length of the manifold for vacuuming said air from said pocket into the manifold, and further including a slit orifice formed at the convergence of the wall panels extending along the length of the manifold and in spaced adjacency with the pocket area of convergence of the on-running felt with the dryer roll, whereby the felt is rid of frictionally indrawn air over the surface of the adjacent wall panel, and air is withdrawn from the area over the dryer roll and from the pocket area of convergence of the on-running felt with the dryer roll.

2. For use in combination with a high speed dryer wherein a felt carries a paper sheet web over dryer rolls, and the felt forms an on-running tangent pocket with the perimeter of a dryer roll and into which pocket air is frictionally drawn by the on-running roll perimeter and felt tending to cause sheet web flutter:

a vacuum device comprising an elongate hollow manifold extending longitudinally within said pocket parallel to said felt and web, said manifold comprising a vacuum chamber defined between a pair of convergent wall panels, respective ones of said wall panels being in parallel spaced adjacency with the on-running felt, and in tangent spaced adjacency with the dryer roll;

and opening means, including an array of vacuum ports in the wall panels, substantially throughout the length of the manifold for vacuuming said air from said pocket into the manifold, and further including a slit orifice formed at the convergence of the wall panels extending along the length of the manifold and in spaced adjacency with the pocket area of convergence of the on-running felt with the dryer roll, whereby the felt is rid of frictionally indrawn air over the surface of the adjacent wall panel, and air is withdrawn from the area over the dryer roll and from the pocket area of convergence of the on-running felt with the dryer roll.

* * * * *